United States Patent [19]

Greenleaf, Jr.

[11] 3,998,736

[45] Dec. 21, 1976

[54] SEWAGE DISPOSAL SYSTEM

[76] Inventor: John W. Greenleaf, Jr., 1451 Brickell Ave., Miami, Fla. 33131

[22] Filed: May 12, 1976

[21] Appl. No.: 685,566

[52] U.S. Cl. ..... 210/104; 210/109; 210/152; 210/533; 137/396

[51] Int. Cl.[2] ..... C02C 1/00

[58] Field of Search ..... 210/97, 103, 104, 109, 210/152, 532, 533; 137/395, 396

[56] References Cited

UNITED STATES PATENTS

| | | | |
|---|---|---|---|
| 2,736,337 | 2/1956 | Parks et al. | 137/395 X |
| 3,536,196 | 10/1970 | Zeff et al. | 210/97 |
| 3,537,472 | 11/1970 | Yulio | 137/396 X |
| 3,844,946 | 10/1974 | Farrell, Jr. | 210/104 |
| 3,875,051 | 4/1975 | Kovarik | 210/104 |

*Primary Examiner*—John Adee
*Attorney, Agent, or Firm*—Watson, Cole, Grindle & Watson

[57] ABSTRACT

A sewage disposal system in which sewage is permitted to accumulate to a desired level in a sump or receptacle, following which it is evacuated from the receptacle through a discharge conduit, by means of a partial vacuum transmitted through the conduit from a central collection point. Disposed in the discharge conduit is a normally closed flow valve, the control of which is by means of a control valve. Negative pressure transmitted through the discharge conduit is utilized both for opening the flow valve and for maintaining it and the control valve opened until the sump is evacuated, at which time atmospheric pressure entering the discharge conduit from the sump acts upon the control valve to close the latter, which in turn shuts off the flow valve. Triggering of the flow valve to commence the evacuation operation may be performed either manually or automatically by means responsive to the rising liquid level within the sump.

11 Claims, 5 Drawing Figures

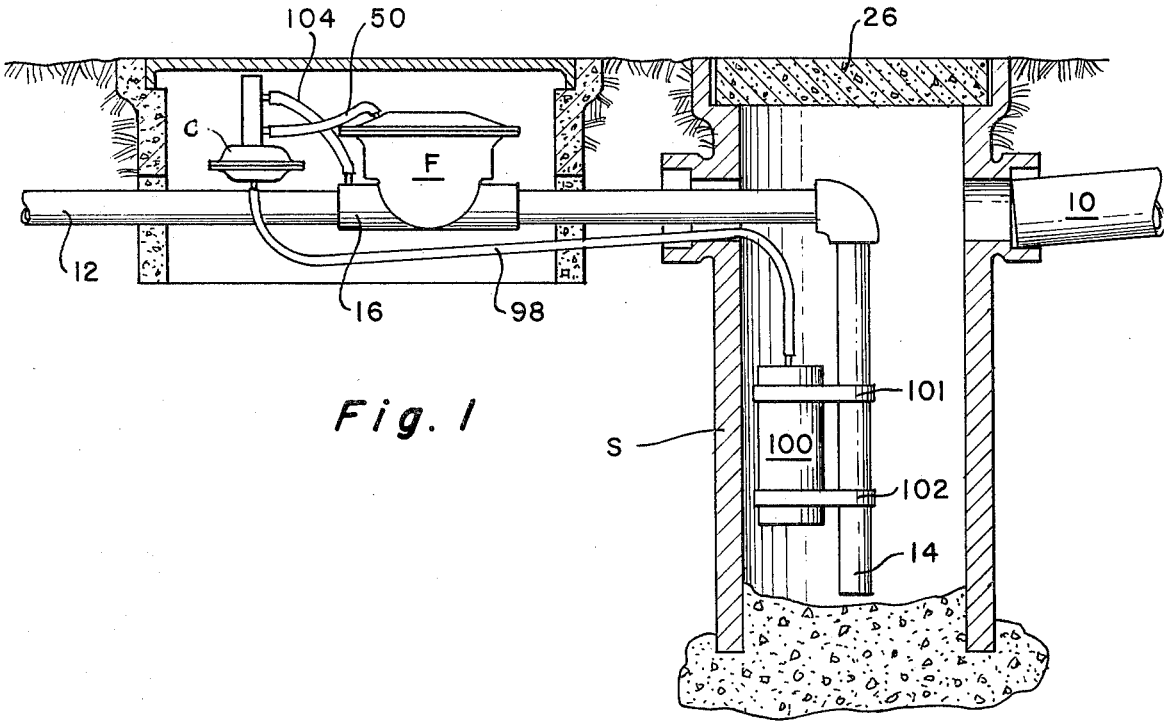
Fig. 1
Fig. 2
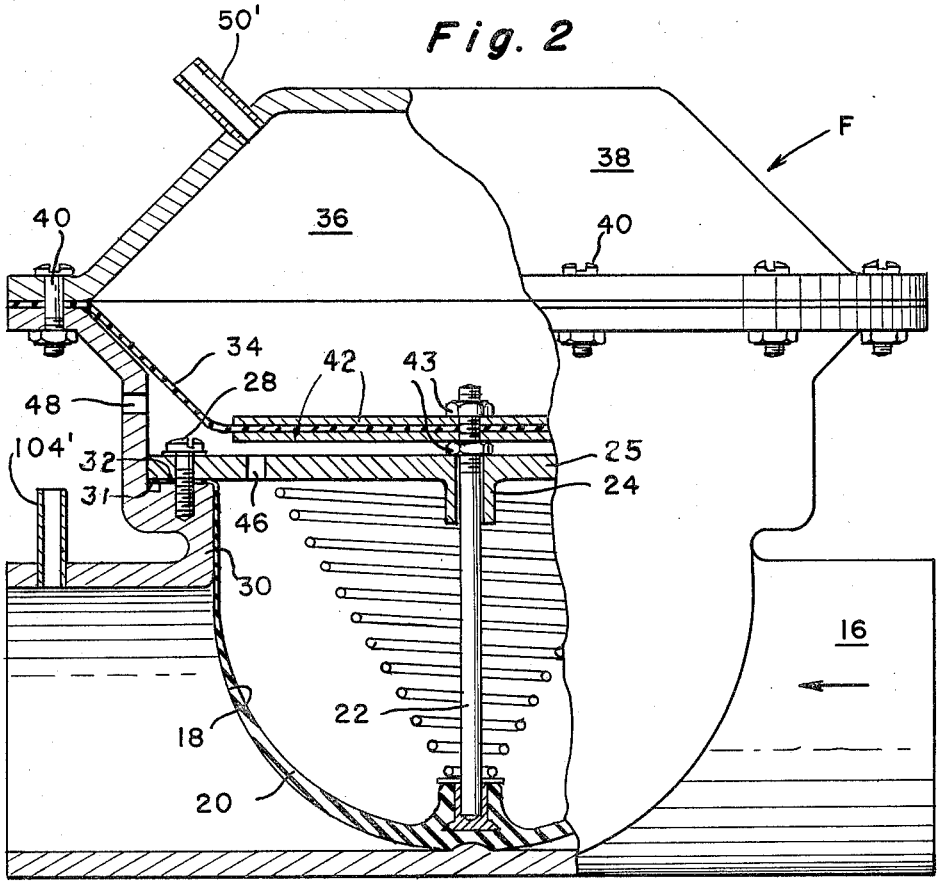

SEWAGE DISPOSAL SYSTEM

This invention relates to improvements in a sewage or waste liquid disposal system of the type in which sewage or other waste liquid is collected from one or more sumps or receptacles and delivered to a central accumulator tank, from which it may thereafter be withdrawn for further transport or treatment. A partial vacuum is maintained in the accumulator tank at sufficient negative pressure to operate the various elements of the system and to overcome any difference in liquid level between that prevailing in the collection receptacle and the accumulator tank, as well as frictional resistance to flow within the collection system. Each individual sump or receptacle preferably located near the source of sewage or other waste liquid and is preferably adapted to receive the liquid flow by gravity. Such receptacle either may constitute a part of a permanent system, as for instance where it is used to collect sewage from a residential unit, or if desired may be detachably connected to the system for selective removal of stored sewage, as where the sump or receptacle is in the form of a holding tank on a vessel.

In accordance with the invention the intake end of the discharge conduit extends to a predetermined level, preferably at or adjacent the bottom of the sump or receptacle, and communicates with the vacuum collection system through a flow valve, the actuation of which is through a control valve. The conrol valve may be adapted for actuation either automatically or manually to cause the flow valve to open so that the vacuum from the collection system communicates through the discharge conduit with the liquid to such the latter from the receptacle into the collection system.

It is an important feature of the invention that after the flow valve has once been opened, it is thereafter retained in fully open position until the sewage or liquid waste within the receptacle or sump has been completely withdrawn to a predetermined level, following which it will completely close automatically to prevent the undesired entrance of air into the collection system.

It is a further feature that, as long as the sump is empty, the control valve will not remain open, even if it should be inadvertently or accidentally opened, but will automatically close to bar air from the collection system. It will remain open only in the event there is sewage within the sump to be removed.

It is a further important feature of the invention, that the discharge conduit through which the sewage is drawn into the vacuum collection system, also functions to transmit controlling pressure variations to the control valve for actuating the latter to close the flow valve automatically when the liquid level is sufficiently lowered in the sump.

Further features consist in the function and arrangement of the control and flow valves to enable them to be located at a common location outside of the sump, where they may be readily available for inspection and servicing without access to the sump, and wherein it is unnecessary to dispose any movable parts of the invention within the sump, thus eliminating the necessity for entry into the sump for repair or servicing.

SUMMARY OF THE INVENTION

In accordance with the invention, the discharge conduit has its open intake end located within the sump at a predetermined level normally below the surface of the sewage therein, the interior of the sump being at substantially atmospheric pressure. A flow valve interposed in the discharge conduit is resiliently biased to a normally closed position in which it interupts fluid flow through the discharge conduit. Included in the flow valve are means for opening it in opposition to its biasing means, such opening means defining a first variable volume chamber in which a diaphragm, piston, or other movable wall portion is connected to the flow valve for movement in a direction to open it in response to the existence of a negative pressure within the chamber. A control valve is operatively connected to the said chamber and to the discharge conduit at a location downstream from the flow valve, and is movable from a first position in which it vents the chamber to the atmosphere to a second position in which it establishes communication between the chamber and the discharge conduit, whereby negative pressure may be transmitted from the discharge conduit to the chamber for opening the flow valve. Associated with the control valve are means defining a second variable volume chamber subject to the discharge conduit internal pressure at said location, and having a movable wall portion connected to the control valve for retention of the latter in its said second position responsive to negative pressure in said second chamber. Resilient means is provided for restoring the control valve to its first position responsive to the existence of atmospheric pressure in the second variable volume chamber.

The actuation of the control valve to cause it to initiate an operative cycle of the disposal system may be achieved either through the application of manual force to the control valve, or through liquid level responsive means within the sump or collection receptacle.

BRIEF DESCRIPTION OF THE DRAWINGS

In order to facilitate an understanding of the invention, specific embodiments thereof are illustrated in the accompanying drawings. However, it is to be understood that the drawings and the descriptive matter relating to same are to be interpreted as merely illustrative of the principles of the invention rather than as limiting the same in any way, since it is contemplated that various changes may be made in the various elements to achieve like results, without departing from the invention as defined by the appended claims.

In the accompanying drawings:

FIG. 1, is a fragmentary view, partly in elevation and partly in section, of a sewage collection system for an individual residence incorporating the features of my invention, including means for automatically triggering an operational cycle of the invention to empty the sump or collection receptacle each time the latter becomes full.

FIG. 2, is a detail view, partly in plan and partly in cross section, of the preferred form of flow valve of the invention.

DETAILED DESCRIPTION OF THE PREFERRED EMBODIMENT

Figure 4:
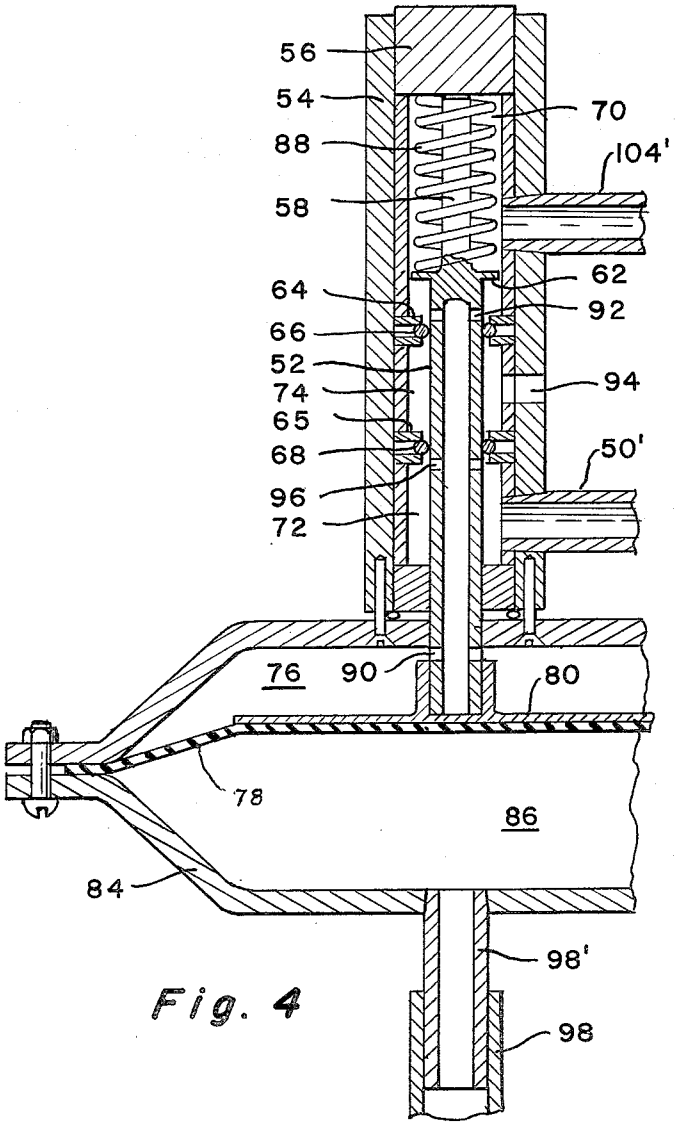
FIG. 4, is a fragmentary view of the structure shown in FIG. 3, but with the parts in a different operational position; and, FIG. 5 is a view of a modified embodiment of the invention as adapted for application to a boat, the major components of the invention being permanently mounted on a dock and adapted for detachable connection to boats or other water craft.

Referring now in detail to FIG. 1 of the accompanying drawings, there is illustrated a sump or receptacle S which is adapted to receive sewage or other liquid waste by gravity through a pipe 10 from one or more residences or buildings, and to permit the accumulation of such sewage or liquid to a predetermined level, at which time in accordance with the invention, the mechanism provided by the invention will be caused to run through an operational cycle to evacuate the contents of the sump through a vacuum collection system into a central accumulator tank for disposition in various known manners.

The vacuum collection system or means includes a discharge conduit 12 communicating with a source of partial vacuum and having an open intake end portion 14 depending into the sump S to a level normally well below the surface of the sewage within the sump and just above the bottom of the sump. The optimum level or position of this intake end is such that it is normally completely covered or submerged in the liquid and just above the sump bottom, thus allowing a substantially complete evacuation of the sump responsive to completion of each operational cycle of the evacuation mechanism of the invention.

The evacuated liquid contents of the sump is adapted for delivery through discharge conduit 12 to an accumulator tank (not illustrated) which is normally maintained under partial vacuum or negative pressure.

Interposed in the discharge conduit 12 at a location adjacent the depending intake end portion 14 thereof is a normally closed flow valve, designated in its entirety by the reference character F. By virtue of its normally closed position, the flow valve prevents transmission of the vacuum or negative pressure from the vacuum collecting system into the sump S which is normally at atmospheric pressure. Air from the atmosphere may freely enter the sump S through its rather loose fitting precast cover 26 and also through the drain pipe 10.

Operation of the flow valve F is under the control of a control valve, designated in its entirety by the reference character C. The sewage disposal system and the assemblage of parts employed therein, as thus far generally described, are substantially in conformity with the disclosures of the prior art as exemplified by U.S. Pat. Nos. Re.28,189, Re.28,008 and 3,746,032.

Referring now in more detail to the individual components and their relationships, initial consideration will be given to the flow valve F, as illustrated in detail in FIG. 2. The housing of the flow valve includes a portion 16 of generally tubular configuration coupled into the discharge conduit 12 in generally conventional manner and defining internally a substantially hemispherical valve seat 18 adapted for cooperation with the resiliently deformable hemispherical valve body 20, which when seated prevents flow of fluid in either direction through the housing and its associated discharge conduit 12.

The valve is opened by collapsing or deforming the valve body 20 to retract it from its seat 18, thus to establish communication between the portions of conduit 12 on opposite sides thereof. A valve rod 22 having its lower end securely attached in suitable manner to the valve body 20, is slidably disposed or guided through a bushing 24 in a generally circular cover plate 25 which has its circular periphery secured by threaded fasteners 28 over the circular opening 30 into the valve seat. The deformable hemispherical valve body 20 is provided with a marginal flange 31 which in accordance with usual practice is clamped in fluid tight relation between the plate 25 and an annular shoulder 32 of the valve housing around the opening 30.

The upper end of the rod 22 is suitably attached to a flexible diaphragm 34 forming a movable wall portion of a first variable volume chamber 36, the remainder of which is formed by the domed housing portion 38, the outer periphery of the diaphragm being securely clamped in fluid tight relation, as by the threaded fasteners 40, between the annular flanges of the valve housing and its domed cover portion 38.

Preferably the valve actuating rod 22 extends through the diaphragm 34 and through metalic stiffening plates 42 disposed on opposite sides of the diaphragm, the upper end of the rod being threaded and secured to the diaphragm and its associated plates by nuts 43 threaded onto the rod.

The resiliently deformable valve body 20 will normally be urged toward seated position by its own inherent resiliency, and preferably also by means of a valve closing coil spring 44 of conical configuration which encircles the valve actuating rod and is compressed between the plate and the valve body.

It will be noted that the interior of the hemispherical valve body 20 communicates through a vent 46 in plate 25 with the space beneath the diaphragm 34 and thence with the atmosphere through a vent 48 the vents thus cooperating to prevent formation of an air lock which might interfere with the movement of either the valve body or the diaphragm. It will be noted further that the atmospheric pressure which thus is permitted to enter the interior of the valve body 18 combines with the negative pressure on the discharge side of the valve, as well as with the inherent resiliency of the valve body itself, to assure firm seating of the valve so as to avoid leakage when the valve is in its closed position.

Moreover the vent 48 in the valve housing permits atmospheric pressure on the underside of the diaphragm to assist in raising the diaphragm in response to creation of a partial vacuum or negative pressure in the variable volume chamber 36 above the diaphragm.

Figure 3:
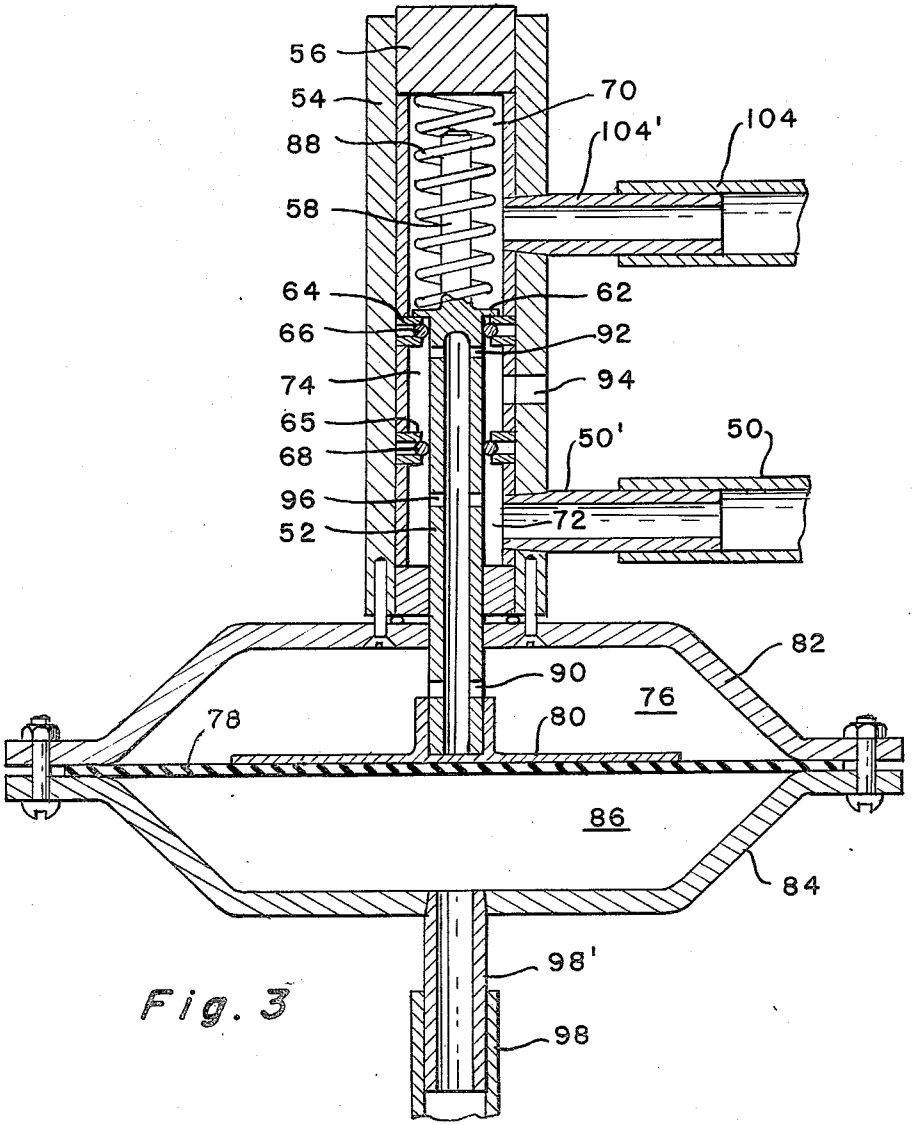
FIG. 3, is a sectional view, of the preferred form of control valve of the invention.

Opening of the flow valve F is achieved through actuation of the control valve C, illustrated in detail in FIGS. 3 and 4, and which communicates with the variable volume chamber 36 of the flow valve through a conduit 50 (FIG. 1) opening into that chamber. The conduit 50 in the present embodiment is connected to the flow valve F and control valve C by way of conventional nipples 50'—50' on the respective valves.

The control valve C (FIGS. 3 and 4) is of the shuttle type, in which the hollow generally cylindrical valve body 52 is disposed for axial movement in a housing 54. The upper end of the housing is closed by a plug 56 which is positioned for engagement by an upwardly projecting valve stem 58 to arrest the upward movement of the valve body 52 when it reaches its fully open position (FIG. 4). The valve body is normally biased toward and retained in its fully closed position by resilient means in the form of a spring 88 which encircles the valve stem and is compressed between the plug or stop 56 and a radial flange 62 which encircles the valve stem and engages the the partition 64 (as in FIG. 3) for limiting the downward closing movement of the valve under the influence of the spring, in the normally fully open position of the valve. The valve body is slidable through upper and lower annular partitions 64 and 66 through ring seals 66, 68 respectively in said partitions which function to isolate the upper, lower and medial valve chambers 70, 72 and 74 from each other.

The lower end of the valve body extends and is movable into a second variable volume chamber 76 defined in part by a flexible diaphragm 78 clamped in fluid tight manner between the encircling flanges of opposed housing members 84, 82 so as to constitute a movable wall portion for the respective chambers or compartments formed within the housing on opposite sides thereof. A rigid disc 80 supported at the lower end of the valve body 52 transmits movement between the diaphragm and the valve body.

The control valve spring 88 normally biases the valve body 52 to and maintains it in its lowermost closed position (illustrated in FIG. 3), in which position the second variable volume chamber 76 communicates with the atmosphere through ports 90 and 92, of the valve body, thence the medial chamber 74, and vent opening 94. Similarly atmospheric pressure is admitted through the valve body 52, ports 96 lower chamber 72 and conduit 50, to the first variable volume control chamber 36 of the flow valve F, thus permitting that valve to remain in its fully closed position.

For triggering the control valve to initiate an operative cycle of the mechanism herein disclosed, it will suffice merely to deflect the diaphragm 78 upwardly either manually or by suitable sewage level responsive means, as more fully hereinafter described. Where the apparatus of the invention is employed in conjunction with the sewage of a residence or other building it is of course desirable to provide for automatic triggering of the mechanism to institute an operative cycle thereof to completely empty the sump S, (FIG. 1) each time the liquid in same reaches a predetermined maximum level.

For this purpose and as illustrated in FIG. 1, the lower or third variable volume chamber 86 beneath the control valve diaphragm 78 is connected by means of the nipple 98' and conduit 98 to the downwardly opening bell chamber 100 which is supported at a predetermined level in the sump, as by means of brackets 101, 102 securing it to the depending intake end portion of the discharge conduit 14.

It will be apparent that as the level of sewage rises within the sump, this will result in compression of air within the bell chamber 100, which pressure will be transmitted through the conduit 98 to the lower chamber 86 of the control valve, whereby to raise the diaphragm 78 and its associated control valve body 52 so that the latter is placed in fully open position with its valve stem 58 in abutment with the stop 56 as shown in FIG. 4. At this time, the valve ports 92 will have been moved through the partition 64 and into communication with the upper valve chamber 70 which, in turn, is connected through nipple 104' and conduit 104 with the discharge conduit 12, at a location downstream of the Flow Valve F so as to have constant negative pressure transmitted thereto. Such negative pressure or partial vacuum is transmitted from the valve ports 92 through the hollow interior of the valve body 52 and through the ports 96 and condit 50 to the variable volume control chamber 76 of the flow valve F, whereby to open the latter.

SUMMARY OF THE INVENTION

To briefly summarize the mode of operation of the apparatus in FIGS. 1 through 4, it will be understood that the control valve C is normally closed during the accumulation of sewage within the sump or receptacle S, but is automatically opened or triggered in response to the rising level of liquid in the sump, to admit negative pressure both to its own control chamber 76 and to the control chamber 36 of the flow valve F. This negative pressure acts upon the valve diaphragms or movable wall portions 78 and 34 respectively to open both valves and to retain them open, in opposition to their respective return springs, for as long as the negative pressure prevails in the control chambers of the respective valves.

Opening of the flow valve F will cause the sewage to be drawn out of the sump S through the suction pipe 14, flow valve F and discharge conduit 12 until the sewage is substantially all evacuated from the sump. It will be appreciated that, as the level of the sewage is reduced to or just below the lower end of the bell chamber 46, the resulting lowering of air pressure within the bell chamber 46 will be transmitted through conduit 98 to the lower chamber 86 of control valve 41, to condition that valve for closing, though it will still be held open for the balance of the evacuation cycle by the negative pressure within the control valve upper chamber 76.

Continued evacuation of sewage from the sump will bring the level thereof to or slightly below the lower open end of the suction pipe 14 so that air from the sump at atmospheric pressure is permitted to enter the suction pipe. Such atmospheric pressure is transmitted through the control valve C to the control chambers 36 and 76 of the control valve and flow valve respectively, thereby permitting automatic closure of both valves by their respective return springs.

With such closure of the flow valve, sewage will again be permitted to accumulate in the sump until the control valve is again triggered or actuated to commence a new evacuation cycle.

DESCRIPTION OF MODIFIED EMBODIMENT

Figure 5:
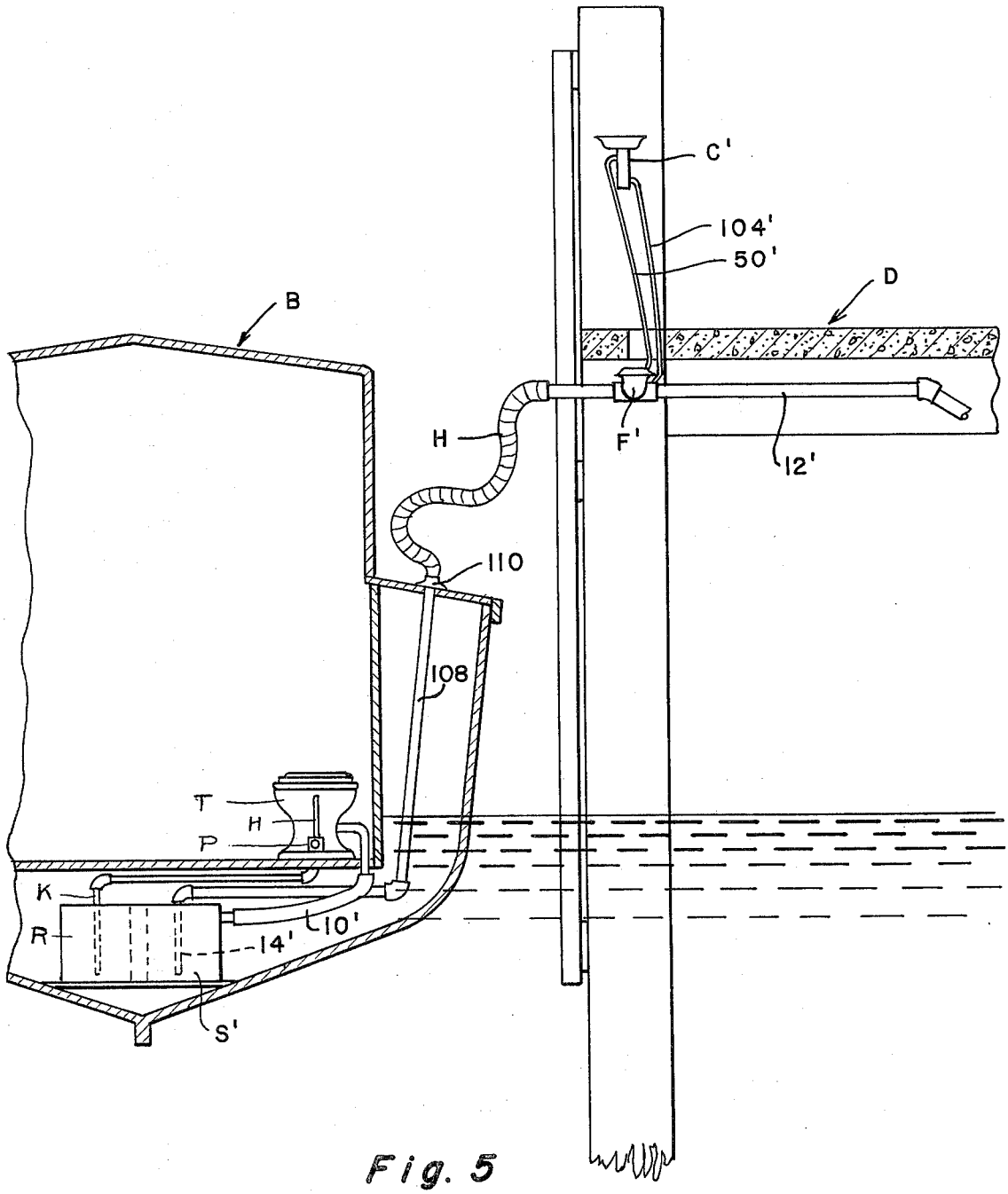

In the modified arrangement illustrated in FIG. 5 of the drawings, the sewage collection system of the invention is shown in a modified form wherein it is embodied in a dockside installation for emptying holding tanks on boats. This is basically similar to the arrangement already described, and accordingly, similar parts will be designated by similar but primed reference characters. The main difference between the modification and the preferred embodiment is that, in the modification of FIG. 5, the liquid level responsive means for automatically triggering the evacuation operation is omitted, and instead the flow valve is manually triggered to initiate the evacuating operation. In addition various of the elements have been relocated in order to adapt them for the dock-side installation.

In FIG. 5 there is shown a fragmentary cross section of a boat B which is moored to a dock D, also shown fragmentarily. A conventional holding tank S' is located aboard the boat, preferably in the bilge thereof, in place of the sump S of the preferred embodiment, while the flow valve F' and control valve C' are disposed at convenient readily accessible locations on the dock D. Thus the flow valve F' is disposed under the flooring of the dock, where it is interposed in the discharge conduit or line 12' and connected by flexible hose section H and clean-out fitting 108 with a suction pipe having a depending open end 14' extending to a location adjacent the bottom of the holding tank S'. Clean-out connection 108 extends from a deck fitting 110, which may be capped when not in use, and terminates at its lower end in the depending suction pipe 14' within the holding tank S'. The holding tank S' may be any of various designs for accumulating and holding sewage and/or other sanitary waste aboard the vessel until it can be removed at dock-side by an evacuating system such as herein described.

The discharge from a marine toilet T is delivered through drain 10' into the sump S'. Water for flushing the toilet is taken from reservoir R and delivered through supply pipe K, by a pump P having a manually operated swingable lever or handle H.

Control valve C' is conveniently and accessibly located above the floor of the dock D and is operatively connected to flow valve F' and to the discharge conduit 12', by conduits 50' and 104' respectively, as described in connection with the preferred embodiment. In general the structures of the control valve C' and flow valve F' and their inter-relationships are identical with those described in the preferred embodiment, except that the automatic sewage level responsive means 98, 100 of the preferred embodiment, for triggering the control valve has been eliminated and, instead, the control valve C' has been slightly modified to permit manual actuation or triggering thereof. For this latter purpose, the pressure chamber 86 of the preferred embodiment has been eliminated, the diaphragm being held in place merely by an annular clamping ring corresponding to the outer periphery of the housing member 84 in FIG. 3. Thus one side of the diaphragm is exposed at all times to atmospheric pressure and is readily accessible to have manual pressure applied thereto to trigger the evacuation operation.

It will be apparent that in each of the illustrated embodiments of the invention, the suction pipe 14, 14', in addition to its usual function of evacuating the sewage from the sump or holding tank, serves the additional function of transmitting atmospheric pressure to the control valve C, C' for the purpose of discontinuing the evacuation operation immediately following its completion, so as to avoid entry into the vacuum collection system of undesired amounts of air such as would render the system inefficient in operation.

Moreover, it will be apparent that if the control valve C or C' is inadvertently triggered or actuated before the sump or holding tank is filled, or even when it is empty, the flow valve will close automatically to prevent the entrance of air into the collection system unless there is sewage therein to be evacuated.

The valving and control means of the invention moreover in either embodiment of the invention are at locations remote from the sump or holding tank, where they may be conveniently accessible for inspection and servicing without requiring the workman to enter or reach into the sump S.

Having thus defined my invention I claim:

1. A vacuum type sewage disposal system comprising:

a sump at atmospheric pressure for reception and accumulation of sewage;

a discharge conduit communicating with a source of negative pressure and having an open intake end normally depending to a level below the surface of sewage within said sump;

a flow valve interposed in said discharge conduit for controlling the flow of fluid therethrough;

resilient means biasing said flow valve to a normally closed position in which it interrupts fluid flow through said discharge conduit;

means for opening said flow valve in opposition to said resilient means, said flow valve opening means defining a first variable volume chamber having a movable wall portion connected to said flow valve for movement in a direction to open said flow valve in response to the existence of a negative pressure within said chamber;

a control valve operatively connected to said chamber and to said discharge conduit on the side of said flow valve remote from said sump, said control valve being movable from a first position in which it vents said chamber to the atmosphere to a second position in which it establishes communication between said chamber and the discharge conduit;

means defining a second variable volume chamber having a movable wall portion connected to said control valve for retention of said control valve in its said second position in response to the existence of negative pressure in said second variable volume chamber;

and resilient means for restoring said control valve to its first position responsive to the existence of atmospheric pressure in said second variable volume chamber.

2. A vacuum type sewage disposal system as defined in claim 1, including means responsive to accumulation of a predetermined amount of sewage in said sump for actuating said control valve to open said flow valve.

3. The combination of claim 2, in which said last mentioned means comprises a downwardly opening bell chamber adapted to have air in the sump compressed therein in response to rising sewage levels in the sump, and means for applying said compressed air to the movable wall portion of said second variable volume chamber in a direction to urge said control valve to its said second position in which it establishes communication between said first variable volume chamber and the discharge conduit.

4. A vacuum type sewage disposal system as defined in claim 1, in which said movable wall portion of the first variable volume chamber comprises a flexible diaphragm.

5. A vacuum type sewage disposal system as defined in claim 4, in which said movable wall portion of the second variable volume chamber comprises a flexible diaphragm.

6. A vacuum type sewage disposal system as defined in claim 1, in which both of said movable wall portions of both said variable volume chambers comprise movable diaphragms.

7. A vacuum type sewage disposal system as defined in claim 5, in which said resilient means for biasing the flow valve to a normally closed position and said resilient means for restoring the control valve to its first said position comprise springs.

8. A vacuum type sewage disposal system comprising:

a sump at atmospheric pressure for reception and accumulation of sewage;

a discharge conduit communicating with a source of negative pressure and having an open intake end normally depending to a level below the surface of sewage within said sump;

a flow valve interposed in said discharge conduit;

resilient means biasing said flow valve to a normally closed position in which it interrupts fluid flow through said discharge conduit;

a first pressure responsive means for opening said flow valve responsive to the action of a negative fluid pressure on said pressure responsive means and for permitting its closure by said resilient means responsive to the action of atmospheric pressure on said pressure responsive means;

a control valve;

a second pressure responsive means connected to said control valve for maintaining same in open position responsive to the action of negative fluid pressure on said second pressure responsive means;

resilient means biasing said control valve toward closed position;

said control valve being operatively connected to said discharge conduit and to both of said pressure responsive means for operation in its open position to admit the negative pressure from said discharge conduit to both of said pressure responsive means, and for operation in its closed position to vent both of said pressure responsive means to the atmosphere.

9. A vacuum type sewage disposal system as defined in claim 8, including means responsive to the accumulation of a predetermined level of sewage in said sump for opening said control valve.

10. A vacuum type sewage disposal system as defined in claim 9, in which said recited pressure responsive means comprise variable volume chambers having movable wall portions thereof connected respectively to said flow valve and to said control valve.

11. A vacuum type sewage disposal system as defined in claim 10, in which said means responsive to accumulation of a predetermined level of sewage in said sump, comprises a bell chamber having a downwardly opening mouth normally below the sewage level within said sump to have air compressed therein by the rising sewage, and means for applying the increasing air pressure within said bell chamber to said control valve for urging same to open position.

* * * * *